United States Patent [19]

Hanyu et al.

[11] Patent Number: 4,457,246

[45] Date of Patent: Jul. 3, 1984

[54] METHOD OF MAKING PATTERN DATA FOR A SEWING MACHINE

[75] Inventors: Susumu Hanyu; Mikio Inamori; both of Tokyo; Eiichi Shomuea, Hachioji, all of Japan

[73] Assignee: Janome Sewing Machine Co., Ltd., Tokyo, Japan

[21] Appl. No.: 538,413

[22] Filed: Oct. 3, 1983

[51] Int. Cl.[3] ..... D05C 17/00

[52] U.S. Cl. ..... 112/266.1; 112/158 E; 112/439

[58] Field of Search ..... 112/266.1, 262.1, 158 R, 112/158 E, 158 A, 158 D, 439, 121.12, 102, 103, 78; D33/9 R, 9 C

[56] References Cited

U.S. PATENT DOCUMENTS 4,200,048 4/1980 Makabe et al. ..... 112/158 E
4,223,616 9/1980 Kunimatsu et al. ..... 112/158 E
4,227,472 10/1980 Bergvall ..... 112/158 E
4,266,493 5/1981 Hanyu et al. ..... 112/158 E

*Primary Examiner*—Peter P. Nerbun
*Attorney, Agent, or Firm*—Michael J. Striker

[57] ABSTRACT

A method of forming a stitch pattern is disclosed in which at least two closely spaced or coincident end stitches are present. The overall pattern is divided into overlapping block sections. In one block, a first group of stitches is formed followed by a second group of stitches being formed in an adjacent block. The number of stitches between closely spaced or coincident stitches that results is reduced. Therefore the accumulated error of fabric feeding pitches and the distance between the two end stitches is reduced resulting in a more precisely constructed overall pattern.

3 Claims, 4 Drawing Figures

METHOD OF MAKING PATTERN DATA FOR A SEWING MACHINE

BACKGROUND OF THE INVENTION

The present invention relates to a method of making pattern data to be stored in a sewing machine for controlling the needle positions and the feeding amounts as well as the directions thereof to thereby provide a selected pattern of stitches.

With respect to sewing machines which use conventional mechanical cams, the number of stitches to be used per pattern is at most 20. It has therefore been sufficient to provide the pattern data on a cam in accordance with a designed pattern in such a manner that the designed pattern may be produced with the stitches continued from the first to the last. For example, the last stitch may be returned accurately to the first stitch of the pattern, because there is not so much accumulated error of the fabric feeding due to the comparatively small number of total stitches.

Recently computer sewing machines have been developed. Such sewing machines electronically store the pattern data for controlling the needle positions and feeding amounts as well as the directions thereof. Moreover the number of different types of pattern data that can be stored is limitless, and accordingly complicated patterns may be produced with many stitches. However, it has often been inconvenient with the conventional method of making the pattern data.

Namely in the case when the patterns are formed from stitches, which include two or more stitches to be required to come to one point or come into alignment after many intervening stitches have been formed between the two stitches, no problem arises in the needle amplitude direction, but a problem arises in the fabric feeding direction. More precisely, two stitches, i.e. a precedingly formed stitch and a later formed stitch will often fail to come to one point or come into alignment due to the accumulated error of feeding pitches intervening between the two stitches, is dependent upon the kind or thickness of fabric to be sewn. As the result, the stitched pattern becomes considerably deformed.

SUMMARY OF THE INVENTION

The invention has been provided to eliminate such defects and disadvantages of the prior art.

It is an object of the present invention to make the pattern data for producing a pattern including two or more stitches to come to one point or come into alignment after many stitches are made between the two stitches. For attaining this object, the pattern data is made up in such a manner that the pattern stitches are divided into blocks that are continuous to each other in the fabric feeding direction. The resultant adjacent stitches may be utilized as the parts of the pattern, and thereby reduce the number of stitches formed between a certain preceding stitch and a later stitch coming to or in alignment with the preceding stitch. Thus the accumulated error of fabric feeding pitches is reduced to the minimum between the two stitches, and the later stitch may be secured to or be in alignment with the preceding stitch, and thus the stitched pattern may obtain an integrity instead of being deformed.

DETAILED DESCRIPTION OF THE INVENTION

Figure 1:
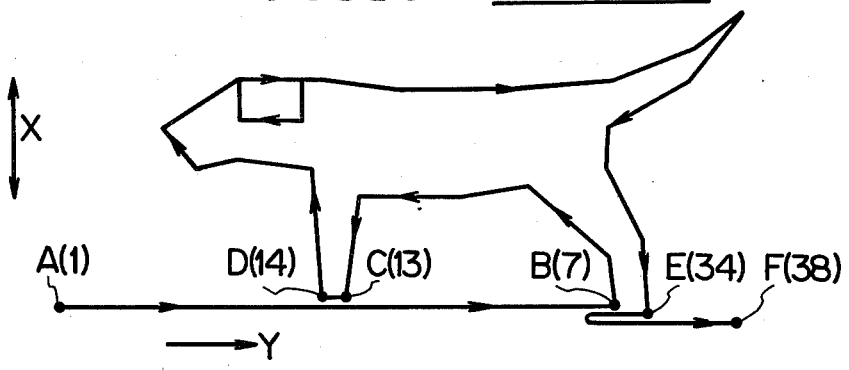
FIG 1 PRIOR ART
FIGS. 1 and 2 show stitch patterns formed in accordance with the conventional making method of pattern data.

A dog pattern will be explained, referring to FIG. 1. The alphabet marks shown main stitches, and the numerals within the parentheses show the stitches in order of the first to the last. "X" designates the amplitude direction and "Y" designates the normal stitching direction. As shown in FIG. 1, when the dog pattern is continuously stitched from the initial stitching A (1st stitch) to the last stitching F(38th stitch) in the direction of arrows, the stitches C(13th stitch) and D(14th stitch) form the thickness of the front paw. In this case, there is only one stitch between the stitches C and D. The thickness of the paw is unchanged if the kind of fabric and the thickness and other factors are changed. However the hind paw is formed by the stitches B(7th stitch) and E(34th stitch) which are substantially in alignment in the feeding direction. There are 27 stitches between the two stitches B, E, and the accumulated error of the feeding pitches will influence the location of the stitch E, and accordingly influence the thickness as well as the configuration of the paw. If the kind of fabric and the thickness are changed, the pattern is spoiled.

Figure 2:
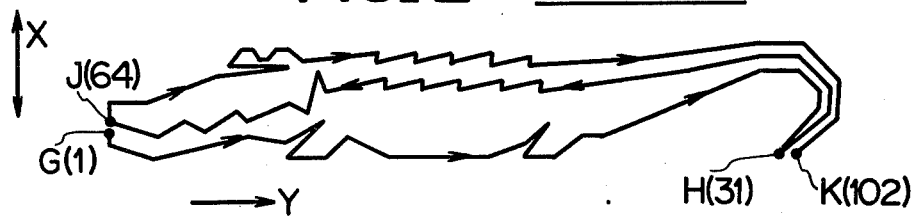
FIG 2 PRIOR ART

A crocodile pattern will be explained as a second example, referring to FIG. 2. As is seen, the crocodile pattern is continuously formed from the initial stitch G(1st stitch) to a last stitching K (102nd stitch). There are two problems in the pattern as it is stitched in the direction of the arrows. One of them is at part of the mouth, and the other is at the end of the tail. The mouth is formed with the stitches G(1st stitch) and J(64 stitch). There are 63 stitches between the two stitches. The end of the tail is formed with the stitches H(31st stitch) and K(102nd) stitch). There are 71 stitches between these two stitches.

Each of the patterns includes a couple of stitches confronted in alignment which will be influenced and deformed by the accumulated error of the 63 or 71 feeding pitches in dependence upon the kind of fabric used and its thickness.

Figure 3:
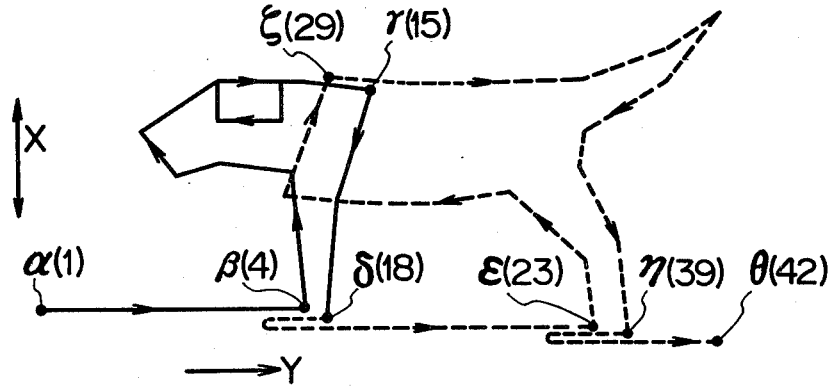
FIGS. 3 and 4 show stitch patterns formed in accordance with the pattern data making method of the present invention.

The present invention will be concretely explained in reference to the following two examples. A dog pattern will be referred to as a first example in FIG. 3. The Greek marks show the main stitches, and the numerals within the parentheses show the stitches from the first to the last in the stitching order. "X" designates the amplitude direction and "Y" designates the normal stitching direction. In the instant example, as shown in FIG. 3, the dog pattern with the initial stitch $\alpha$(1st stitch) to the last stitch $\theta$(42nd stitch) is divided into two blocks in the feeding direction. The first stitch block includes the head part and the front paw formed with the stitches 4–18, and the second stitch block includes the body part and the hind leg formed with the stitches 18–39. These stitch blocks are combined with one another with certain overlapping parts continued therebetween. In such a manner, the stitching data is provided. The overlapping parts of the stitch blocks are utilized as a part of the pattern, such as a collar of the dog. In this case, the stitched pattern includes these couples of stitches confronted to each other in alignment.

That is, one couple is composed of the stitches $\beta$(4th stitch) and $\delta$(18th stitch) representing the thickness of the paw, another couple is composed of the stitches $\gamma$(15th stitch) and $\xi$(29th stitch) representing the thickness of the collar, and the other couple is composed of the stitches $\epsilon$(23rd stitch) and a stitching $\eta$(39th stitch) representing the thickness of the hind paw.

The number of stitches between the respective stitch couples is as follows: $\beta$ to $\delta$ is 14 stitches, $\gamma$ to $\xi$ is 14 stitches, and $\epsilon$ to $\eta$ are 16 stitches. The numbers are less than 27 between the couple of stitches B and E representing the thickness of the hind paw of the stitch pattern as shown in FIG. 1. Thus the integrity of the pattern may be secured due to the reduction of stitches between the two stitches in question, with the accumulated error of feeding pitches being minimized.

Figure 4:
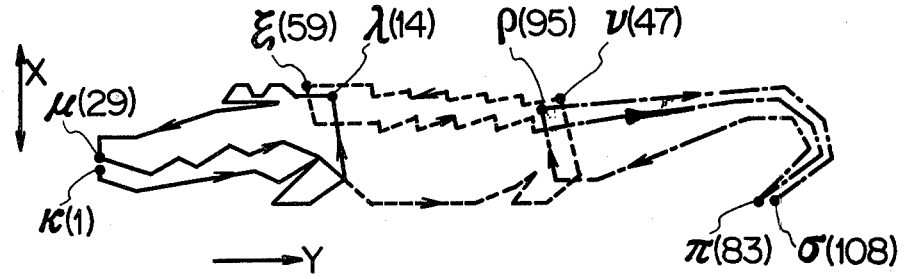

A further reference will be made to stitching of a crocodile pattern in FIG. 4. In this example, the pattern of the stitches from the initial one K(1st stitch) to the last one $\sigma$(108th stitch) is divided into three blocks in the feeding direction.

The first stitch block is a head part shown with the arrows "——>——", the second stitch block is a body part shown with the arrows "- - - - - - - - - >- - - - - -", and the third stitch block is a tail part shown with the arrows "—·—·—>—·—·—".

Thus, the pattern data is provided in such a manner that the first stitch block to the third stitch block contain the certain overlapping portions as mentioned between the adjacent stitch blocks. The overlapping parts between the first and second stitch blocks and between the second and third stitching blocks are utilized to represent the carapace patterns of the crocodile, which will not spoil the appearance. The accumulated errors, if any, of the feeding pitches will not amount to the value that will separate the adjacent stitch blocks overlapped with certain width. With respect to the number of stitches between the couples of stitches, there are 45 stitches between the couple of stitches $\lambda$(14th stitch) and $\xi$(59th stitch), and 48 stitches between the couple of stitches $\nu$(47th stitch) and $\rho$(95th stitch). These stitches are many but their number create no substantial problem.

There is another two couples of stitches in the pattern. One of them are the stitches $\kappa$(1st stitch) and $\mu$(29th stitch) at the mouth of the pattern and the other are the stitches $\pi$(83rd stitch) and $\sigma$(108th stitch) at the end of tail. The number of intervening stitches is 28 in the former and 25 in the latter. As compared to FIG. 2, these stitch numbers are less than 63 between the stitches G and J and less than 71 between the stitches H and K in FIG. 2. Thus the deformation of the pattern by the accumulated error of the feed pitches is improved.

What is claimed is:

1. The method of producing by a sewing machine a pattern including at least two end stitches arranged at least in alignment with one another in a feeding direction and a plurality of intermediate stitches therebetween, the method comprising the steps of dividing a pattern into a plurality of blocks disposed adjacently in the feeding direction and connected to each other with overlapping parts so that a number of intermediate stitches between end stitches aligned in the feeding direction of each of said blocks is less than the number of intermediate stitches between the end stitches of the pattern; and forming a pattern by making stitches in said blocks successively in one block after the other.

2. The method as defined in claim 1, wherein said dividing step includes forming said blocks so that their overlapping parts constitute at least one element of the pattern.

3. The method as defined in claim 1, wherein said dividing step includes dividing the pattern in which the two end stitches are formed in one point.

* * * * *